United States Patent [19]

Licari

[11] 4,297,795

[45] Nov. 3, 1981

[54] PORTABLE DRYING RACK

[76] Inventor: Vito Licari, 875 Ocean Ave., Elberon, N.J. 07740

[21] Appl. No.: 157,004

[22] Filed: Jun. 6, 1980

[51] Int. Cl.[3] ..... F26B 9/10

[52] U.S. Cl. ..... 34/239; 211/198; 211/200; 211/202

[58] Field of Search ..... 34/239; 211/195, 198, 211/182, 199, 200, 201, 202

[56] References Cited

U.S. PATENT DOCUMENTS

| | | | |
|---|---|---|---|
| Re. 16,324 | 4/1926 | Schmitt . | |
| 19,107 | 1/1858 | Stone . | |
| 31,013 | 1/1861 | Durand . | |
| 31,538 | 2/1861 | Frazee . | |
| 114,527 | 5/1871 | Chubb et al. . | |
| 127,881 | 6/1872 | Hill | 211/202 |
| 263,945 | 9/1882 | Nelly . | |
| 419,668 | 1/1890 | Hawes . | |
| 482,269 | 9/1892 | North . | |
| 638,417 | 12/1899 | Miller, Jr. . | |
| 872,235 | 11/1907 | Himmel . | |
| 1,095,238 | 5/1914 | Shadduck . | |
| 1,109,275 | 9/1914 | Andrews . | |
| 1,138,498 | 5/1915 | Moore . | |
| 1,533,470 | 4/1925 | Schmitt . | |
| 1,692,704 | 11/1928 | Rohrig . | |
| 2,310,770 | 2/1943 | Evans . | |
| 2,415,784 | 2/1947 | Block . | |
| 2,445,403 | 7/1948 | Mayerman . | |
| 2,524,190 | 10/1950 | Cooper . | |
| 2,706,829 | 4/1955 | Charnin . | |
| 3,133,645 | 5/1964 | Cecil . | |
| 3,298,537 | 1/1967 | De Marco . | |
| 3,917,073 | 11/1975 | Kulkey . | |
| 4,131,205 | 12/1978 | Malecki . | |
| 4,202,372 | 5/1980 | Gibbons . | |

FOREIGN PATENT DOCUMENTS

| | | | |
|---|---|---|---|
| 166136 | 11/1955 | Australia . | |
| 11783 | 8/1888 | United Kingdom | 211/202 |
| 919306 | 2/1963 | United Kingdom . | |
| 1009218 | 11/1965 | United Kingdom . | |

*Primary Examiner*—Larry I. Schwartz

*Attorney, Agent, or Firm*—Lerner, David, Littenberg & Samuel

[57] ABSTRACT

A portable drying rack is provided which comprises frames of unitary construction for hanging articles and support members for supporting the rack in an upright position. The support members are pivotably attached to the frames to permit the drying rack to be collapsed for storage. The pivotable attachment between the frames and support members is accomplished by means also of unitary construction. The unitary construction employed throughout the present invention allows a light-weight drying rack to be formed utilizing inexpensive injection molded plastic. Additionally, because of the unitary construction, the number of components forming the rack is decreased over the prior art.

7 Claims, 7 Drawing Figures

PORTABLE DRYING RACK

FIELD OF THE INVENTION

The present invention relates to portable drying racks having frames for hanging articles and support members pivotably attached to the frames for supporting the rack in an upright position.

Even more particularly, the present invention relates to such portable drying racks in which the frames are of unitary construction and in which the pivotable attachment between the frames and support members are also of unitary construction.

BACKGROUND OF THE INVENTION

Portable drying racks which can be set up in the open or in the bathtub of an apartment and then collapsed for transport or storage, have been in widespread use for many years. The structure of such drying racks generally comprises a large assemblage of many separate elements. Often the elements are fabricated from wood, rope, and metal. As a result of the material selection and the concomitant complexity of assembling such different materials, the production of the finished rack is accomplished not without some degree of expense. Moreover, wood and metal construction produces a structure not without weight and therefore decreases the ease with which such a structure can be transported.

Accordingly, it is a primary object of the present invention to produce a drying rack which can be fabricated from inexpensive materials.

It is a further object of the present invention to produce a drying rack which is easy to assemble.

It is a still further object of the present invention to produce a light-weight drying rack which can be easily transported.

SUMMARY OF THE INVENTION

In accordance with the foregoing, the portable drying rack of the present invention comprises at least a pair of first frame and support members crossing one another at their centers and at least an allochiral pair of parallel spaced second frame and support members. The frame and support members are positioned so that the frame members of the pairs are located between the first and second support members. A plurality of parallel spaced connecting members are provided which extend transversely with respect to the frame members. The connecting members are connected at opposite ends thereof to the frame members to form a first frame of unitary construction. A pivotable attachment means of unitary construction is provided for pivotably attaching the first support member at its center to the center of the first frame member and the second allochiral frame member at its center to the center of the allochiral second support member. Additionally, a latching means is provided which is operative to connect the first frame to the support members when the first frame and the support members are pivoted into a cruciform configuration so that the rack can be stood in an upright position upon the first frame and first support members with the first frame members upwardly inclined from the horizontal. The latching means is also operative to disconnect the first frame from the support members so that the rack can be collapsed.

As a preferred embodiment, the drying rack can be provided with a second frame of unitary construction.

As another preferred embodiment, the latching means can comprise a third frame of unitary construction.

As yet still another preferred embodiment, the support members can be provided with an aperture at each location at which the support members pivotably attach to the frame members. In this embodiment, the pivotable attachment means can comprise at each location a pin integral at one end with the frame member extending through the aperture. The opposite end of the pin has an enlarged head portion to prevent the pin from disengaging from the aperture.

The frames and the pivotable attachment means of the present invention are of unitary construction; that is, they are simultaneously formed in a molding operation such as injection molding. The unitary construction utilized throughout the present invention, permits the drying rack to be fabricated from a single inexpensive material such as plastic thus decreasing production costs of the rack. Additionally, the elements forming the frames and the pivotable attachment means do not have to be separately assembled. Moreover, since the unitary construction lends itself to plastic forming techniques, a lightweight structure which is easy to transport can be produced.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

Figure 1:
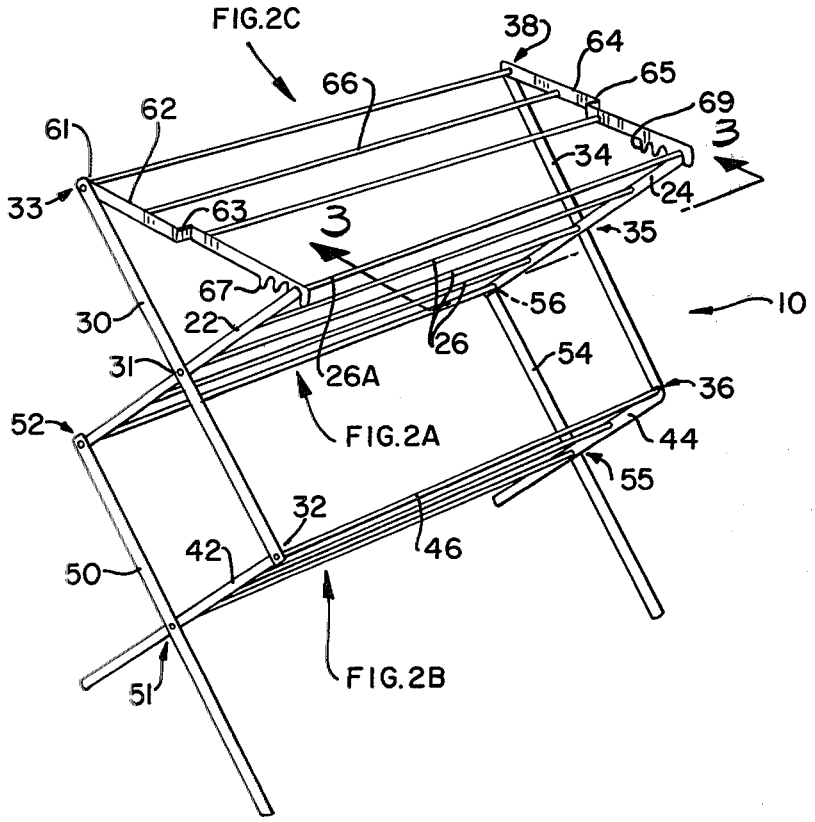
FIG. 1 is a perspective view of a preferred portable drying rack of the present invention.

FIG. *2a* is a plan view of the first frame of the drying rack in the direction of the arrow shown in FIG. 1.

FIG. *2b* is a plan view of the second frame of the drying rack in the direction of the arrow shown in FIG. 1.

FIG. *2c* is a plan view of the third frame of the drying rack in the direction of the arrow shown of FIG. 1.

FIG. *2d* is a plan view of the second support member of the drying rack of FIG. 1.

FIG. *2e* is a plan view of the fourth support member of the drying rack of FIG. 1.

Figure 3:
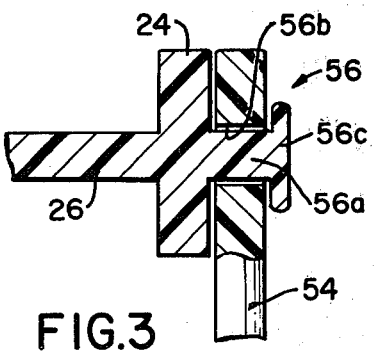

FIG. 3 is a partial cross-sectional, elevational view of the portable drying rack of FIG. 1 taken along section line 2—2 illustrating the pivotable attachment between the frame and the support members.

DETAILED DESCRIPTION

While the present invention is by no means limited to the embodiment illustrated herein, the invention will, for simplicity, be described in connection therewith.

Referring now to FIG. 1, a preferred portable drying rack 10 of the present invention is illustrated. Drying rack 10 generally comprises a first pair of frame and support members 22 and 30; an allochiral second pair of parallel spaced frame and support members 24 and 34; a third pair of frame and support members 42 and 50; and an allochiral fourth pair of frame and support members 44 and 54. A plurality of parallel spaced connecting members 26 and 46 are also provided. The connecting members 26 are connected to the frame members 22 and 24 to form a first frame 20 of unitary construction. The connecting members 46 are connected to frame members 42 and 44 to form a second frame 40 of unitary construction. A pivotable attachment means of unitary construction is provided to pivotably attach the first and second frame 20 and 40 to the first, second, third, and fourth support members at 32, 35, 36, 37, 51, 52, 55, and 56. Additionally, a latching means is provided which can comprise frame members 62 and 64 and connecting means 66 to form a third frame 60 of unitary construction. Pivotable attachment means of unitary construction are provided to pivotably attach the third frame 60 to the support members 30 and 34 at 33 and 38.

Figure 2A:
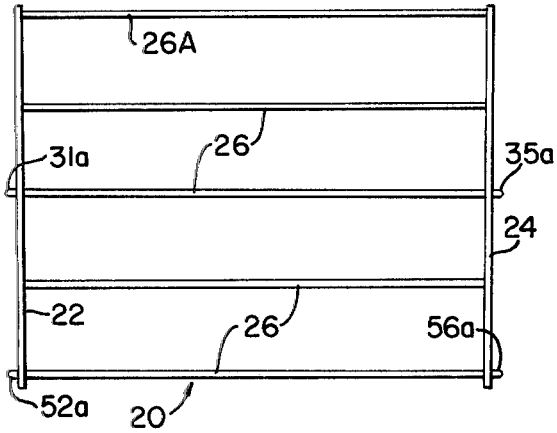

As illustrated in FIG. 1 the drying rack of the present invention comprises a pair of first frame and support members 22 and 30 and a second pair of frame and support members 24 and 34. The first and second support members 30 and 34 at their centers cross the respective centers of the frame members 22 and 24. A plurality of parallel spaced connecting members 26 extend transversely with respect to the first and second frame members 22 and 24. The connecting members 26 are connected at opposite ends thereof to the frame members 22 and 24 to form a first frame 20 which is illustrated in FIG. 2*a*. The first frame member 20 is of unitary construction; that is the connecting members 26 and the frame members 22 and 24 are molded as one piece together with the pivotable attachment means in a single molding operation. The pivotable attachment means, pivotably attaches the first support member 32 to the first frame member 22 and the second support member 34 to the second frame member 24.

The rack 10 illustrated in FIG. 1 can also comprise a pair of third frame and support members 42 and 50 and an allochiral pair of parallel spaced fourth frame and support members 44 and 54. The third and fourth frame members 42 and 44 are positioned so that they underlie the first and second frame members 22 and 24 and are parallel thereto. The third and fourth support members 50 and 54 are positioned so that they underly and are parallel to the first frame and support members 22 and 24. A plurality of parallel spaced connecting members 46 extend transversely with respect to the third and fourth frame members 42 and 44 and are connected at opposite ends thereof to form a second frame 40, illustrated in FIG. 2*b*. The second frame is also of unitary construction and is formed in the same manner as the first frame 20. Additionally, a pivotable attachment means is provided for pivotably attaching the third support member 50 at its center to the center of the third frame member 42 at 51 and at one end to one end of the first frame member 22 at 52. The pivotable attachment means pivotably attach the fourth support member 54 to the fourth frame member 44 at 55 and the second frame member 24 at 56. The pivotable attachment means additionally pivotably attach the first and second support members 30 and 34 at one end to one end of the third and fourth frame members 42 and 44 at 32 and 36.

It is understood that the present invention can contemplate a drying rack comprising several tiers of unitarily formed frames 20 and 40. Alternatively, the present invention can contemplate a drying rack having only a single frame 20.

The latching means maintains the rack 10 in the upright position illustrated in FIG. 1. The latching means can comprise fifth and sixth frame members 62 and 64 and a plurality of parallel spaced connecting members 66 connected at opposite ends thereof to frame members 62 and 64. The frame members 62 and 65 and the connecting members 66 form a third frame 60 illustrated in FIG. 2*c*. The third frame 60 is also of unitary construction. Each of the latching members 62 and 64, are provided at one end with a securement means to secure the third frame 60 to the first frame 20. The securement means can comprise a plurality of depending ratchet-like teeth 67 and 69 at the ends of frame members 62 and 64. The ratchet-like teeth are spaced to engage the uppermost connecting member 26*a*. In the illustrated embodiment, in order for teeth 67 and 69 to engage the uppermost connecting member 26*a*, central "S" bends 63 and 65 are provided in the frame members 62 and 64 such that the ends of the latching members and hence the teeth 67 and 69 are located between frame members 22 and 24. Pivotable attachment means are provided to pivotably attach the frame 60 at the opposite ends of the frame members 62 and 64 to the ends of the first and second support members 30 and 34 at 33 and 38. The pivotable attachment between the members allows the third frame 60 to be pivoted towards and away from the first frame members 22 and 24 to engage and disengage teeth 67 and 69 with and from the uppermost connecting member 26*a*.

When the drying rack 10 is extended into its upright position illustrated in FIG. 1, the frames and support members are in a cruciform configuration. The third frame 60 is then operative to be pivoted towards the first frame to engage teeth 67 and 69 with the uppermost connecting member 26*a*. With the teeth 67 and 69 so engaged, the first and second support members 30 and 34 are connected by the third frame 60 to the first frame 20. Since the second frame 40 is also pivotably connected to the first frame 20 by first and second support members 30 and 34 and third and fourth support members 50 and 54, the rack then can be stood in upright position upon the frame members 42 and 44 and the support members 50 and 54 with the first frame 20 and the second frame 40 upwardly inclined from the horizontal. When the third frame 60 is pivoted away from the first frame 20 and the teeth 67 and 69 are disengaged from the uppermost connecting member 26*a*, the rack can be collapsed with the first, second, and third frames 20, 40, and 60 against one another, the first and third support members 30 and 50 against one another and the second and fourth support members 34 and 54 against one another.

FIG. 3 illustrates the pivotable attachment means utilized in pivotably attaching support member 54 to frame member 24 at 56. The pivotable attachment illustrated is typical of that utilized throughout the present invention. As illustrated, the pivotable attachment can comprise a pin 56*a* integral at one end with frame member 24 and an aperture 56*b* in support member 54. Pin 56*a* is provided with an enlarged head 56*c* sized to prevent pin 56*a* from disengaging from aperture 56*b*. Pin 56*a* is unitarily formed during formation of frame member 20 as a peg-like projection of frame number 24. The projection is provided with a sufficient length such that a portion of the projection protrudes through aperture 56*b*. Head 56*c* is formed by melting the protruding portion and applying pressure towards frame member 24.

Although the pin 56*a* is illustrated as being connected to frame member 24, it is understood that the pin 56*a* could be connected to support member 54. In such case, frame member 24 would be provided with an aperture and connecting element 26 would be displaced slightly to one side.

Figure 2D:
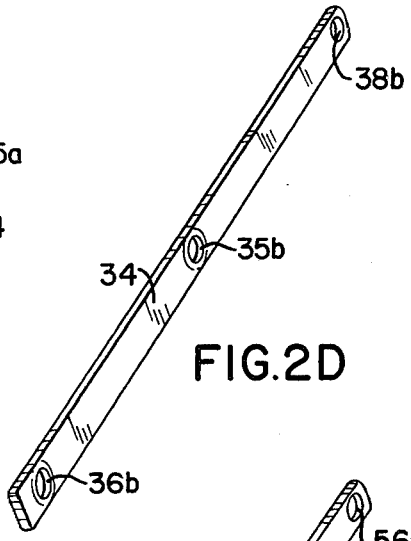
Figure 2B:
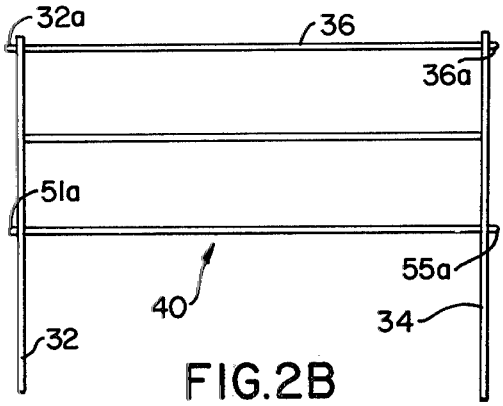
Figure 2E:
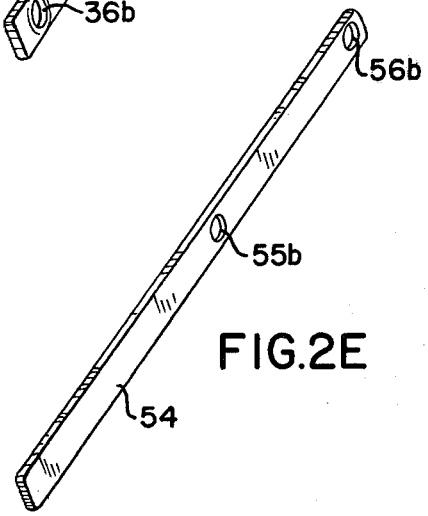
Figure 2C:
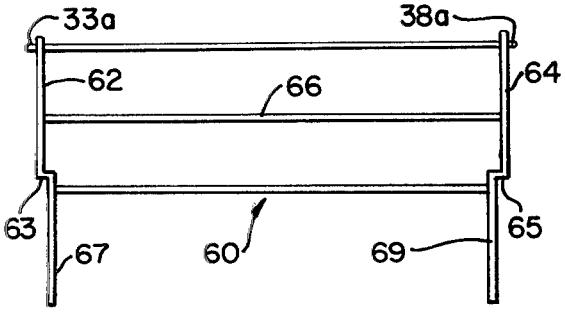

As stated previously, the pivotable attachment utilized in the present invention is similarly formed at other locations of pivotable attachment in the frame 10. Thus, frame 20 is molded with projections 31*a*, 35*a*, 52*a*, and 56*a*; frame 40 is molded with projections 32*a*, 36*a*, 51*a*, and 55*a*; and frame 60 is molded with projections 33*a* and 38*a*. Referring now to FIGS. 2*d* and 2*e*, which respectively illustrate the support members 34 and 54, apertures 36*b*, 35*b*, and 38*b* are formed during molding of support member 34; and apertures 55*b* and 56*b* are formed during the molding of support member 54. The support members 30 and 50 are similarly formed and provided with apertures.

The rack 10 of the present invention is assembled by extending pin 56*a* of frame 20 through aperture 56*b* of support member 54 and extending pin 55*a* of frame 40 through aperture 55*b* of support member 54. The remainder of the rack is assembled in a like manner with corresponding numbered pins and apertures. Afterwards, as mentioned previously, the enlarged head portions are formed to prevent the pins from disengaging from the apertures.

The advantage of the construction of the pivotable attachment means as discussed hereinabove is that they obviate the need for metal fasteners and the like and thus also serve to lessen the cost of the preferred portable drying rack of the present invention.

The portable drying rack of the present invention can be molded from pigmented plastic such as polypropylene in a single molding operation.

It is understood that the forms of the invention herein illustrated and described are to be taken as a preferred embodiment. Various changes and omissions may be made without departing from the spirit and scope of the invention as described in the appended claims.

What is claimed is:

1. A portable drying rack of molded integral construction comprising, a pair of molded supporting members, first and second unitary frames each molded to include a pair of parallel spaced frame members and a plurality of connecting members extending transversely therebetween, integrally molded attachment means pivotally attaching said supporting members to the frame members of said first frame in parallel spaced relationship for pivotal movement between a folded and cruciform configuration, said second pivotally attached at one end between said supporting members and said first frame for bracing said supporting members and said first frame when in said cruciform configuration and collapsible therewith when in said folded position, and securing means formed at one end of said second frame for releasably securing said supporting members and said first frame in said cruciform configuration.

2. The portable drying rack as set forth in claim 1 wherein one end of the frame members of said second frame are pivotally attached to one end of said supporting members by integrally molded attachment means and the other end of the frame members of said second frame having said securing means formed therefrom.

3. The portable drying rack as set forth in claims 1 or 2 wherein said supporting members are pivotally attached to the frame members of said first frame near their respective centers.

4. The portable drying rack as set forth in claim 1 further including a second pair of molded supporting members, a third unitary frame molded from a pair of parallel spaced members and a plurality of connecting members extending transversely therebetween, and integrally molded attachment means pivotally attaching said second pair of supporting members to said third frame in parallel spaced relationship for pivotal movement between a folded and cruciform configuration, one end of said second pair of supporting members and said third frame being respectively pivotally attached by integrally molded attachment members to one end of said first pair of supporting members and said first frame for pivotal movement therewith between said folded and cruciform configuration.

5. The portable drying rack as set forth in claims 1 or 4 wherein the frame members of said second frame include a central "S" bend so that said securing means can be located overlying said connecting members at one end of said first frame and said securing means comprise a plurality of ratchet-like teeth for releasably engaging the uppermost connecting member of said first frame when said portable drying rack is arranged in an upright position.

6. The portable drying rack as set forth in claims 1 or 4, wherein said supporting members have an aperture at each location at which said supporting members are pivotally attached to the frame members and wherein said attachment means comprise, at each of said locations, an integral pin molded thereat with the frame members and extending through said aperture, said pin having a head portion for preventing said pin from disengaging from said aperture.

7. The portable drying rack as set forth in claims 1 or 4, wherein said first and second pair of supporting members and the frame members of said first and third frames are of equal length.

* * * * *

UNITED STATES PATENT AND TRADEMARK OFFICE

CERTIFICATE OF CORRECTION

PATENT NO. : 4,297,795

DATED : November 3, 1981

INVENTOR(S) : Vito Licari

It is certified that error appears in the above-identified patent and that said Letters Patent are hereby corrected as shown below:

Column 3, line 7, "means" should read --members--.
Column 5, line 45, after "second" insert --frame--.

Signed and Sealed this

*Ninth* Day of *March 1982*

[SEAL]

*Attest:*

GERALD J. MOSSINGHOFF

*Attesting Officer*

*Commissioner of Patents and Trademarks*